US006416443B1

(12) United States Patent
Choy et al.

(10) Patent No.: US 6,416,443 B1
(45) Date of Patent: Jul. 9, 2002

(54) EXERCISE TREADMILL EXPANSION CONTROL SYSTEM

(75) Inventors: Ricky T. K. Choy, Santa Ana; Stan Huang, Irvine, both of CA (US)

(73) Assignee: Unisen, Inc., Irvine, CA (US)

( * ) Notice: Subject to any disclaimer, the term of this patent is extended or adjusted under 35 U.S.C. 154(b) by 0 days.

(21) Appl. No.: 09/468,966

(22) Filed: Dec. 21, 1999

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 6,050,822 A * 4/2000 Faughn ..... 482/54
6,123,647 A * 9/2000 Mitchell ..... 482/54
6,152,854 A * 11/2000 Carmein ..... 482/4

* cited by examiner

*Primary Examiner*—Glenn E. Richman
(74) *Attorney, Agent, or Firm*—George F. Bethel

(57) ABSTRACT

An exercise treadmill with a deck retention system including a frame with a deck supported resiliently on the frame. A continuous belt having an upper run over the deck and a lower run under the deck is driven by a roller connected to a motor. A glide surface is connected to the frame in contact with a front and/or rear edge of the deck. At least one roller can be connected to the frame and emplaced in contact with the edge of the deck to restrict longitudinal movement of the deck between the glide surface and the roller. Alternatively, instead of the roller a second glide surface in contact with the edge of the deck opposite from the first glide surface, or a second roller can be placed to allow up and down movement of the deck between the rollers and/or the plastic glide surfaces while restricting longitudinal movement.

24 Claims, 7 Drawing Sheets

EXERCISE TREADMILL EXPANSION CONTROL SYSTEM

BACKGROUND OF THE INVENTION AND PRIOR ART

1. Field of the Invention

The field of this invention lies within the treadmill exercise field directed toward simulated walking, jogging, or running. The treadmill has a moving belt that moves around a pair of rollers over a deck underlying the belt that is in turn mounted on a frame. The invention particularly pertains to the aspects of the deck movement and the control of such deck movement.

2. Prior Art

The prior art with regard to exercise treadmills encompasses a number of concepts. Some of these concepts incorporate rollers on which a moving surface is placed. Others involve the aspects of allowing for a surface being moved through a number of linkages.

Lately, it has been common to create an exercise treadmill by having a moving belt. The moving belt is generally supported at either end by a pair of rollers. At least one of these rollers is driven by a motor so as to turn the belt.

Underlying the belt, and generally emplaced between the upper and lower runs or portions of the belt is a deck. This deck generally constitutes a board like member. The board like member can be formed of plywood, a composite, or in the alternative a plastic or metal underlying framework or deck. Lately, it has been customary to utilize a densified fiber board. Overlying the densified fiber board is a plastic laminate.

The plastic laminate serves to provide a wear and low friction surface over which the belt can move.

It has also been customary to support the deck on a substantially resilient elastomeric substrate. This elastomeric substrate can be in the form of various configurations. However, in this particular case, the inventors have found that a single non-plural strip along a frame member underlying the deck has given significantly improved performance.

The resilience of the continuous single elastomeric strip between the deck and a frame member allows for the deck to flex or move upwardly and downwardly. The control by this invention during flexure of longitudinal movement and expansion enhances the overall performance.

The inventors have specifically provided for means to check the longitudinal movement of the deck. This longitudinal checking force has been provided in a manner to allow the deck to nevertheless move upwardly and downwardly.

The improvement is such wherein a distribution of the load or deflection is more evenly provided. This enhances the overall function of the deck as it moves upwardly and downwardly on the elastomeric underlying substrate.

Further to this extent, the checking of the longitudinal movement has a beneficial effect in diminishing the pivoting nature of the deck, or uneven movement from the front to the back. Such uneven movement can be an outgrowth of the user being at various locations on the deck that do not necessarily follow the center of support.

Another benefit of this invention is that it allows for upward and downward movement on a mote even and consistent basis. The shifting of the deck is diminished while at the same time allowing for a consistent movement.

All of the foregoing features and other improvements as an outgrowth of this invention can be seen in the specification hereinafter.

SUMMARY OF THE INVENTION

In summation, this invention comprises an exercise treadmill having a moveable belt over an improved deck that is supported for upward and downward movement yet checked and diminished as to its longitudinal movement.

More specifically the invention provides for a deck which is allowed to move upwardly and downwardly and is restricted or diminished as to longitudinal expansion, deflection, and movement. The limitation of longitudinal expansion can be accomplished by a pair of rollers or contacts at one end of the deck and one or more bearing surfaces or contact members at the other end. Further to this extent, rollers can be used at either end or other bearing surfaces or contacts if desired. The net result of the respective bearing surfaces and/or rollers is to diminish and restrict the longitudinal expansion of the deck.

The foregoing diminishing of the longitudinal expansion provides for an improvement in distributing the deflection of the deck more evenly. This more even distribution of the deflection results in improved performance.

Another feature of this invention is that the deck is diminished in its pivoting or canting movement. This is due to the fact that the support against longitudinal expansion or movement at either end diminishes the tilting, canting, or pivoting nature of the deck upon impact.

An outgrowth of the improved deck is that as the deck travels or flexes upwardly and downwardly it has a more even travel path. This allows for improved performance by the user.

DETAILED DESCRIPTION OF THE PREFERRED EMBODIMENTS

Figure 1:
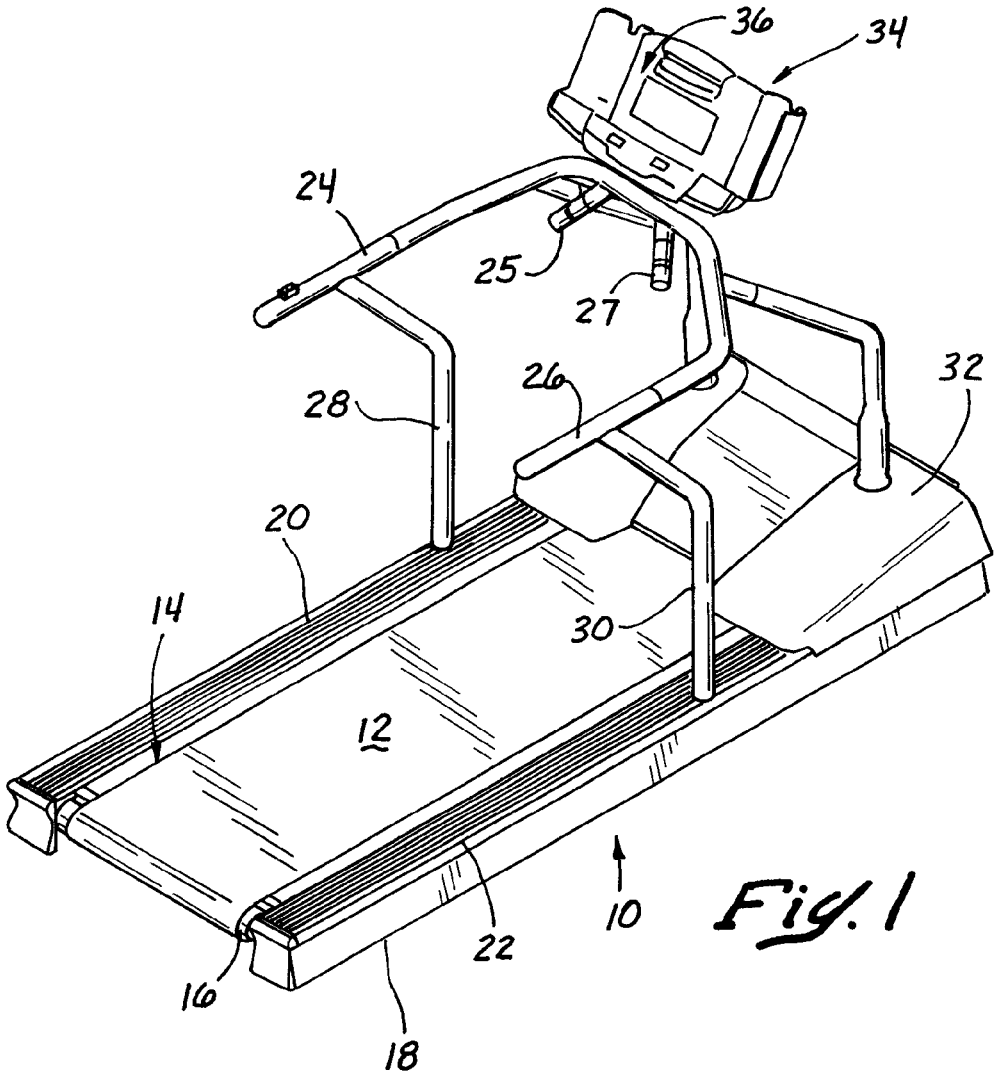
FIG. 1 shows a perspective view of an exercise treadmill incorporating this invention.

Looking specifically at FIG. 1, it can be seen that a treadmill 10 is shown. The treadmill 10 incorporates a moving platform or belt 12 on which a person exercising, walks, jogs or runs. The belt moves at a speed in order to allow for the foregoing exercise movements. The upper run or segment of the belt is supported on a deck that can slightly be seen, namely deck 14. Deck 14 is shown as a generally descriptive deck that will be further defined and characterized in the three respective embodiments hereinafter.

In order to provide for movement of the belt, a pair of rollers at the front and the back are utilized. One is a drive roller and the other is an idler roller. The back roller is shown as idler roller 16.

In order to support the treadmill, a frame 18 is utilized having a pair of edge moldings 20 and 22 that help to cover the frame and the interior portion thereof.

A left hand rail 24 and a right hand rail 26 are supported on stanchions 28 and 30 that are connected to the frame. The hand rails 24 and 26 are also supported by two forward stanchions that are connected in turn to the frame through a fairing or shroud 32 over the mechanical parts including the motor and some of the requisite controls.

A display 34 is utilized having a display panel 36 with controls for increasing and decreasing the relative speed of the belt 12. The hand rails 24 and 26 can also be enhanced by grips 25 and 27 that can also be connected and utilized to measure the user's heart rate.

The foregoing generally comprises a treadmill exerciser which is somewhat known in the art from the standpoint of the general functions thereof.

Looking more specifically at FIGS. 2, 3, 4, 5, 6A, and 6B, it can be seen where a first embodiment has been shown. This first embodiment can be seen as an exploded view in Figure 2 wherein a frame 44 having cross members 46 are connected to outer longitudinal left rail member 48 and right rail member 50. When referring to the left and right orientations of the treadmills, the convention is to refer to them with regard to the orientation of a user on the treadmill facing forwardly in the exercising position with respect to their left and right hand.

The frame 44 also has a motor plate 52 with elevation and hand rail attachment brackets 54 and 56 that extend upwardly with a cross member 58 thereacross. The foregoing generally forms the frame structure and allows for the support of the various components of the exercise treadmill.

Looking more particularly at the deck area it can be seen that a deck 60 has been shown. The deck 60 is formed of a medium density fiber board. The fiber board can be such wherein it can be substituted for plywood, plastic laminates, steel decking, honeycomb composites and other weight bearing deck materials.

The deck 60 in this case has 8 polyethylene glides, or glide surfaces symmetrically oriented around the deck's edge. These polyethylene glides 64 can be seen as buttons fastened on the side edge regions as well as the rear portions and forward portions of the deck placed in a symmetrical manner.

The deck 60 in order to allow for reduced friction of the belt moving thereover is provided with a phenolic laminate or other low friction plastic adhered to the deck.

Figure 6A:
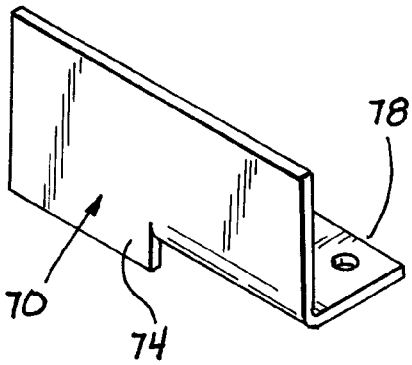
FIGS. 6A and 6B are brackets respectively from the right side and left side of the treadmill as oriented with regard to the user standing on the treadmill.
Figure 6B:
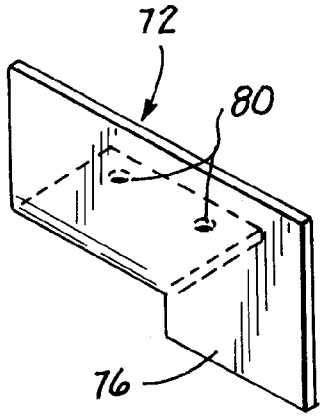

In order to provide for a deck edge which can be longitudinally controlled in its movement, a pair of brackets shown in FIGS. 6A and 6B are utilized. The bracket of FIG. 6A is shown as bracket, glide or contact plate 70 while the bracket of FIG. 6B is shown as bracket, glide or contact plate 72. These respective brackets 70 and 72 are right and left brackets. The brackets 70 and 72 have depending portions 74 and 76 which serve as a contact surface for a guide, control roller, or contact member that will be described hereinafter. In order to attach the plates or brackets 70 and 72 to the deck 60, a pair of openings collectively shown as 78 and 80 in each one can be seen that are screwed or bolted into holes 79 and 81 in the deck. These openings 78 and 80 receive screws, bolts or other means for securing the brackets, glide plates or contacts 70 and 72 into place onto deck 60 in holes 79 and 81.

Figure 2:
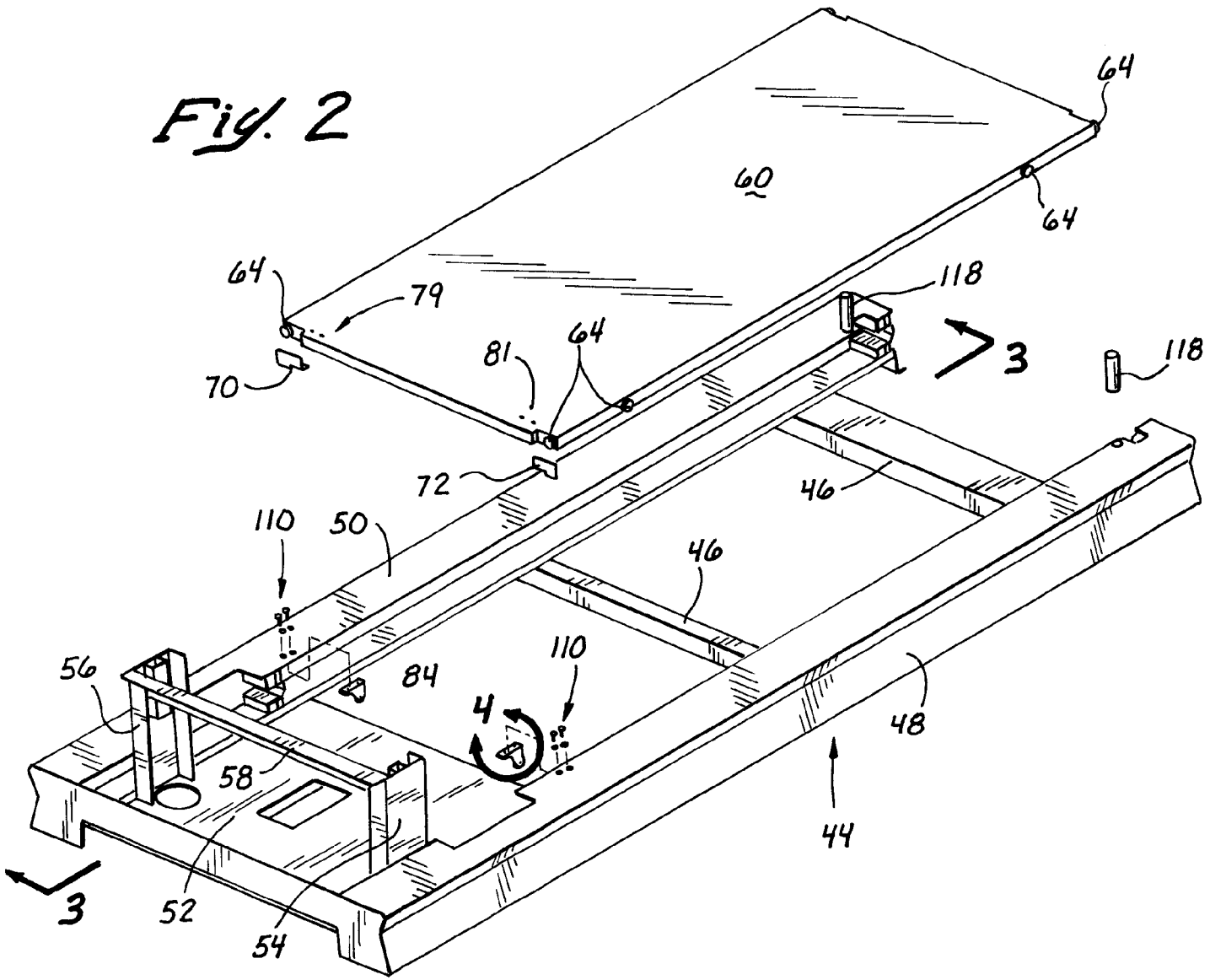
FIG. 2 shows a perspective exploded view of the deck and the frame of a first embodiment of this invention.
Figure 4:
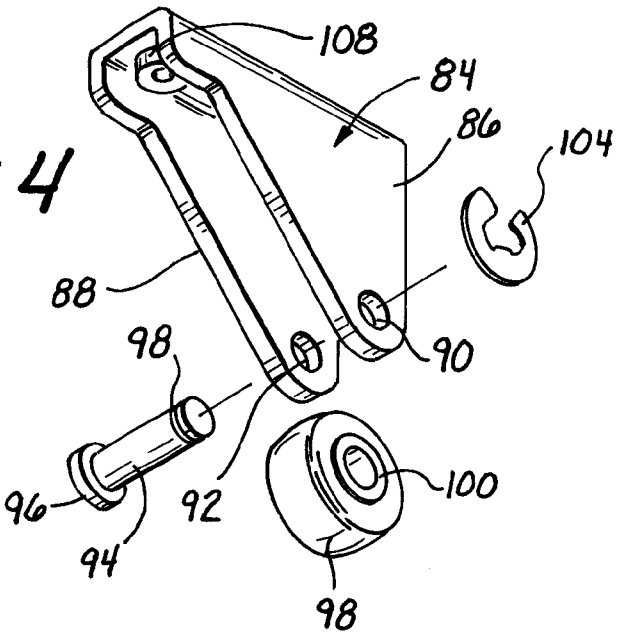
FIG. 4 is a detailed exploded showing of a bracket and roller as shown in FIG. 2.
Figure 5:
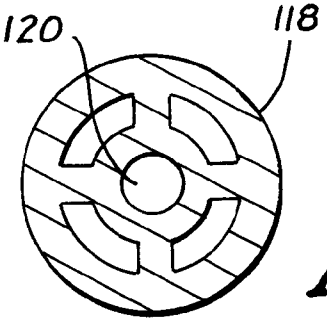
FIG. 5 is a sectional view of a guidepost or rod in the direction of lines 5—5 of FIG. 3.

Looking more specifically at FIG. 4 in conjunction with the showing of FIG. 2 it can be seen that a roller bracket 84 has been shown constituting a pair of bracket arms 86 and 88. Bracket arms 86 and 88 each have a journal opening 90 and 92 which receive an axle, pin, or rod 94 with a head 96 on one end and a groove 98 on the other. The axle, pin, or rod 94 is inserted into the openings 90 and 92 to receive a Delrin roller 98 that can have a bearing 100 that can be a plain bearing surface or a ball or roller bearing. The rod 94 with the roller 98 is inserted and secured by a lock or E clip 104 that engages the groove 98 of the pin 94.

Figure 3:
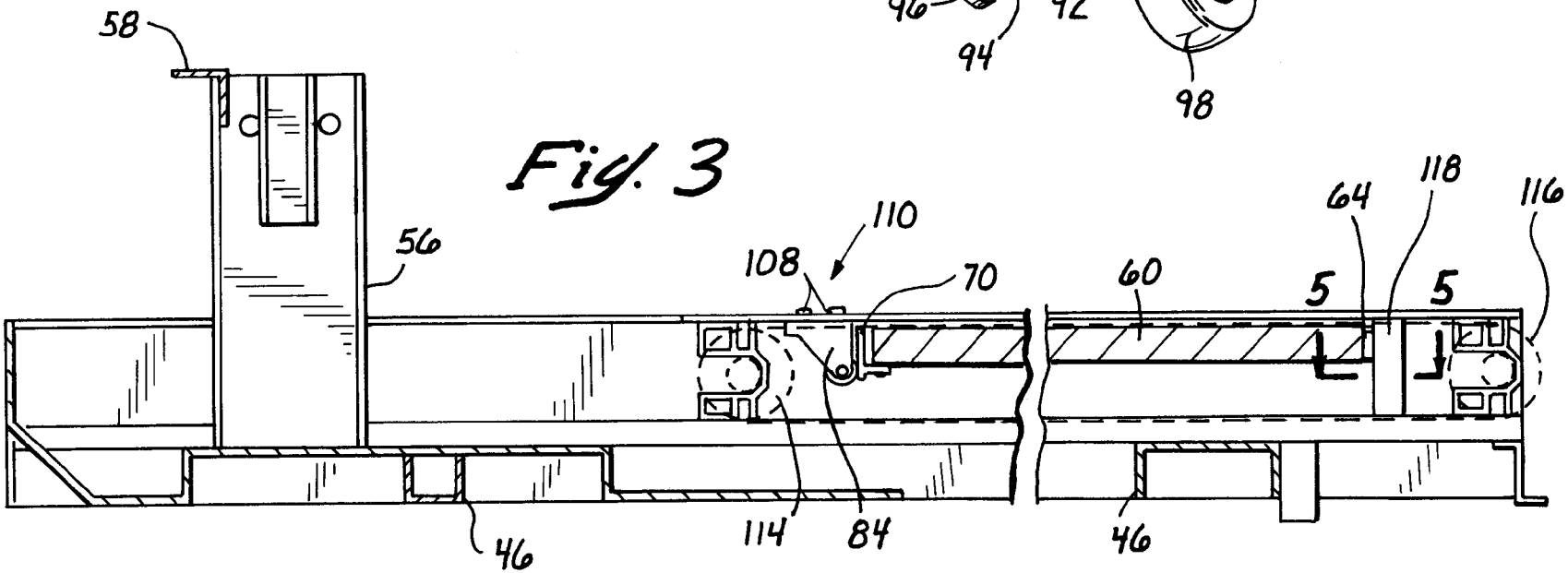
FIG. 3 is a fragmented partially sectioned view in the direction of lines 3—3 of FIG. 2.

In order to secure the bracket 84, a pair of pressed in nuts 108 are utilized. These in turn receive screws, bolts, or any other type of securement means such as machine screws 110 that are received therein in order to secure the bracket 84 to the longitudinal frame members 48 and 50. These bolts 110 are backed as can be seen in FIG. 2 by washers to place the bracket 84 in an underlying position to the frame for contact of the roller 98 against the contact brackets, glides, or contacts 70 and 72 as can be seen in FIG. 3.

In order to move the belt 60 overlying the deck 60, a respective drive roller and idler roller 114 and 116 are shown. These are merely for illustrative purposes but can be oriented in any suitable direction.

A Delrin rod 118 is shown having an opening 120 for receipt of a screw, bolt, or other fastening means to be threaded into the frame 44, in this case the longitudinal members 48 and 50. The rod 118 is supported interiorly by webs to allow for the through hole 120 in the circular configuration to be spaced, reinforced, and secured at the interior for receipt of a screw of bolt therethrough. The rod 118 is placed in such a manner that it is in adjacent juxtaposition to the deck 60 and in particular the frictional engagement button, glide or contact 64. Thus, as the deck 60 is held in place, the contact, or low friction button, glide or other low friction surface 64, that can be any type of glide or contact, is in contact with the Delrin rod 118 that allows for movement upwardly and downwardly between the two interfacing contact surfaces.

When the bracket 84 with the roller 98 is against the upright portion of the brackets, glides or contact plates 70 and 72 they are placed in snug relationship. The roller 98 then allows for travel of the brackets 70 and 72 upwardly and downwardly against the roller. This attendantly allows for upward and downward movement of the deck 60. As can be appreciated at this point the snug placement by securing the screws 110 to the frame 44 in a tightened position prevents longitudinal movement of the deck 60. This prevention of longitudinal movement while at the same time allowing for upward and downward movement of the deck 60 has been deemed to be a vast improvement.

It should be understood that any type of longitudinal checking, restricting or blocking arrangement including rollers at either ends, rods with glide surfaces at either ends, contactors, glides against brackets such as brackets 70 and 72 that allow for upward and downward movement without longitudinal expansion can be utilized. It has been found that this utilization of the roller 98 is an enhancement, such that the deck 60 is able to move upwardly and downwardly. At the same time the deck 60 is checked or blocked in a significant manner against longitudinal movement. A most efficacious desired net result is upward and downward movement with diminished, and restricted longitudinal movement.

Looking more specifically at FIGS. 7, 8, 9, and 10 it can be seen wherein a frame 200 is shown having longitudinal portions or frame members 202 and 204 and respective cross members 206 spanning the two longitudinal frame members 202 and 204.

In order to allow for operation of the treadmill, a motor mount 210 is shown having motor mount studs. Hand rail mounting tubes 212 and 214 are shown, while an elevation motor bracket 216 is also shown.

A deck 220 is provided for movement of a belt thereover as in the prior showings. The deck 220 is made of a medium density fiber board with a phenolic laminate thereover. Here again, the deck 220 can be formed of plywood, various laminates of various densities, as well as honeycomb, metal, and plastic configurations of a singular or composite form.

Figure 7:
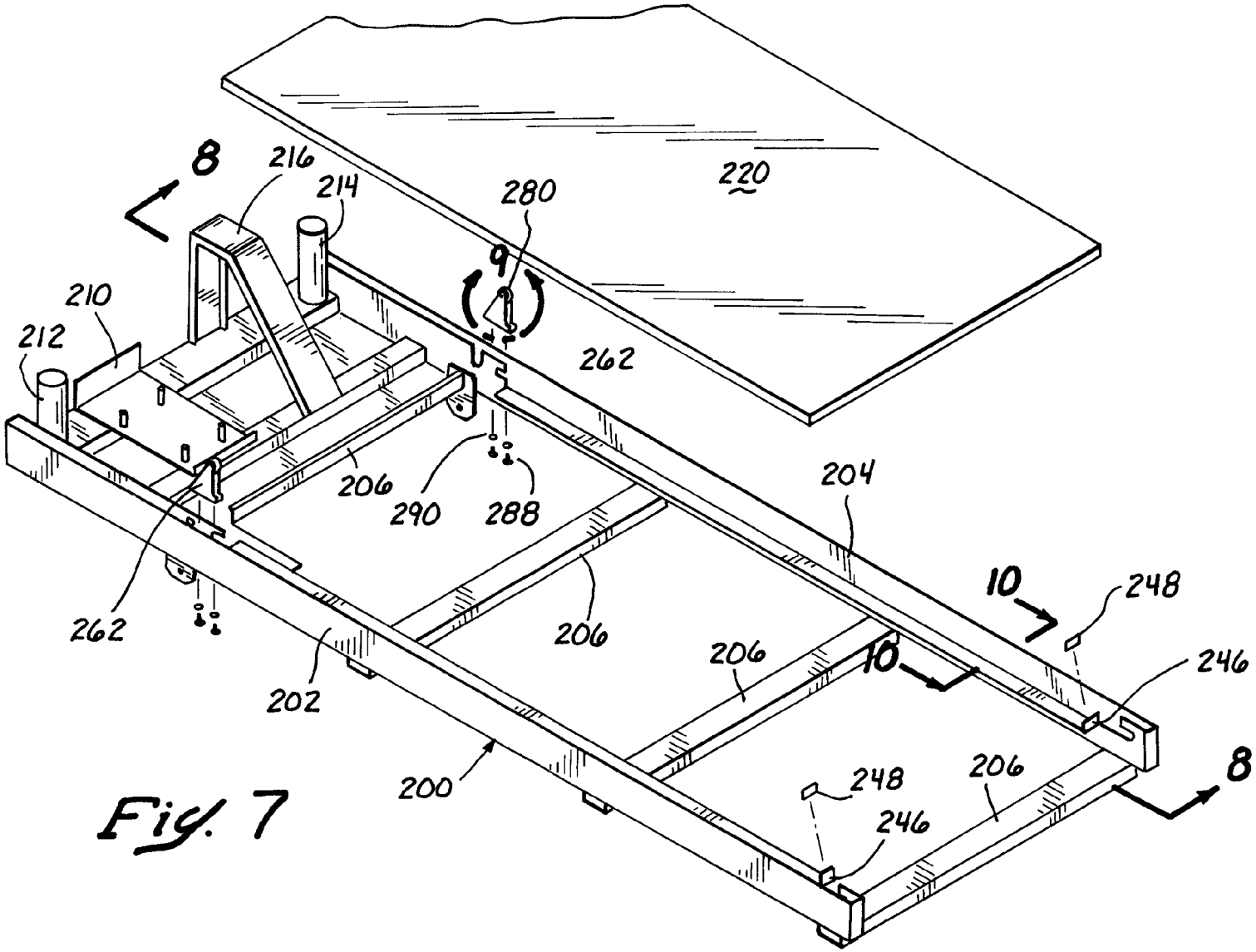
FIG. 7 is an alternative exploded perspective view of the deck and frame upon which it is mounted.
Figure 9:
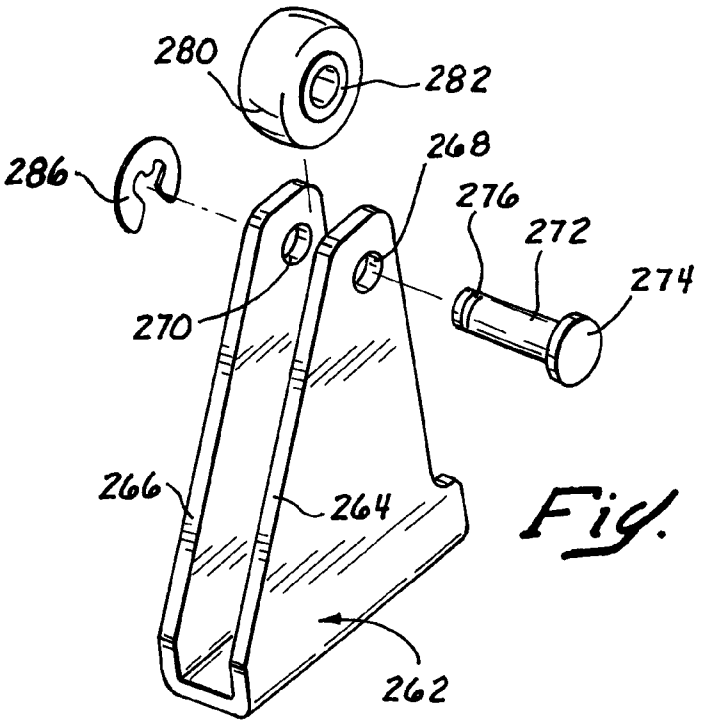
FIG. 9 is an exploded perspective detailed showing of the bracket and roller as partially encircled by circle 9 of FIG. 7.
Figure 10:
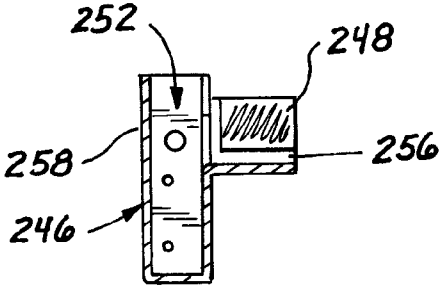
FIG. 10 is a sectional showing of the bracket and glide strip as shown in the direction of lines 10—10 of FIG.
Figure 8:
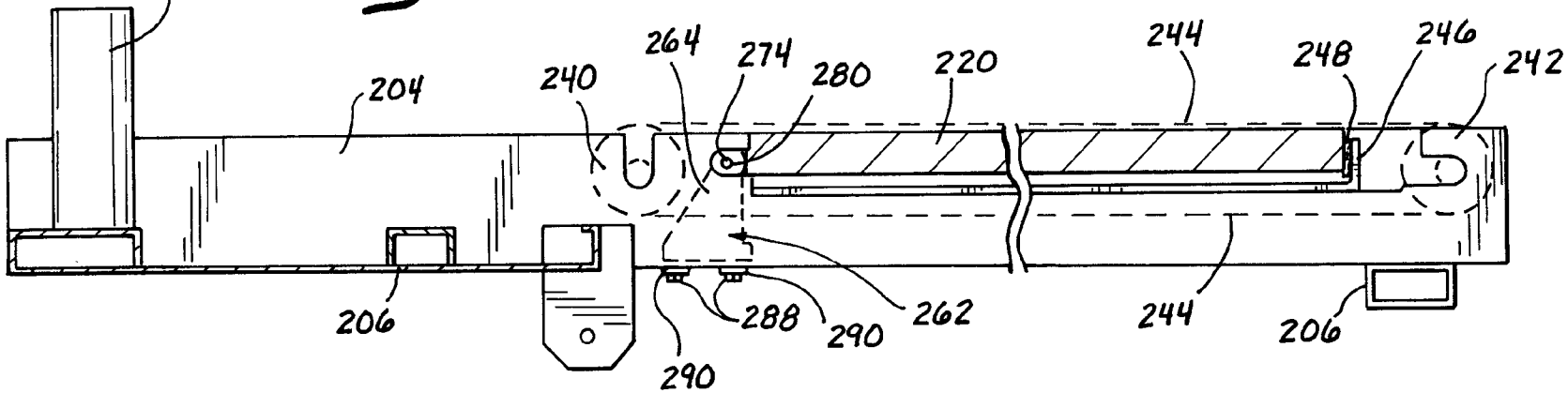
FIG. 8 is a fragmented and partially sectioned view in the direction of lines 8—8 of FIG. 7.

Looking more specifically at FIGS. 8, 9, and 10 as derived from FIG. 7 it can be seen that the components are shown in greater detail. In particular, it can be seen wherein the frame 200 mounts a drive roller 240 and an idler roller 242 for receipt of a belt 244 traveling therearound.

The deck 220 is shown in a position whereby the longitudinal movement thereof is checked, restricted or diminished by virtue of a plate and roller combination. The deck 220 is firstly emplaced against an upstanding bracket 246. This upstanding bracket 246 is shown connected to the frame 244 on either side. The upstanding bracket 246 is provided with a Teflon strip or low friction glide 248 forming a deck contactor. The Teflon strip or glide 248 allows for gliding movement of the edge of the deck 220 thereagainst.

The Teflon strip 248 and bracket 246 in combination can be welded or screwed to the frame by means of screw holes 252 or other fastening means. As can be understood welding, riveting, and threading screws of various types can be utilized to hold the bracket 246. The bracket 246 can mount the Teflon strip 248 in any particular manner but in this case is shown against an upright portion 256. Such items as the strip 248 can be substituted by a glide button as shown in the other embodiments hereof or other restricting contacts. Also, the configuration of the upright bracket portion such as bracket upright 258 can be substituted by any other configuration to provide support to a glide surface such as the Teflon strip 248.

The FIG. 9 showing details an upright generally U shaped bracket 262 having two upright members of the U 264 and 266. The upright portions 264 and 266 of the U have openings 268 and 270 that receive a pin 272 having a head 274 and a slot 276 therein. The pin 272 Ls received therethrough and serves as an axle, support, or journal member for a roller 280 having a bearing 282 that can be formed of any suitable bearing material, or a friction reducing bearing such as a roller or ball bearing.

In order to secure the roller 280 to the bracket 262 a clip such as an E clip 286 is shown which receives the slot 276 therein.

The bracket 262 is connected to the frame on either side by means of bolts 288 that are backed by washers 290. This can be seen in the view of FIG. 8 as well as the other view of FIG. 7. Other means of attachment can be used to attach the bracket 262 instead of the bolts, such as screws, rivets, or clips, sliding frictional engagements and other means.

The roller 280 should be placed in close juxtaposition to the edge of the deck 220. In this manner, it allows the deck 220 to move upwardly and downwardly against the glide surface or contact provided by the Teflon strip 248 or other glide means while traveling against the roller 280 serving the opposite contact function. The net result is to provide for steadiness, diminishing of longitudinal flexure, while at the same time allowing for relatively even displacement upwardly and downwardly of the deck 220.

Figure 11:
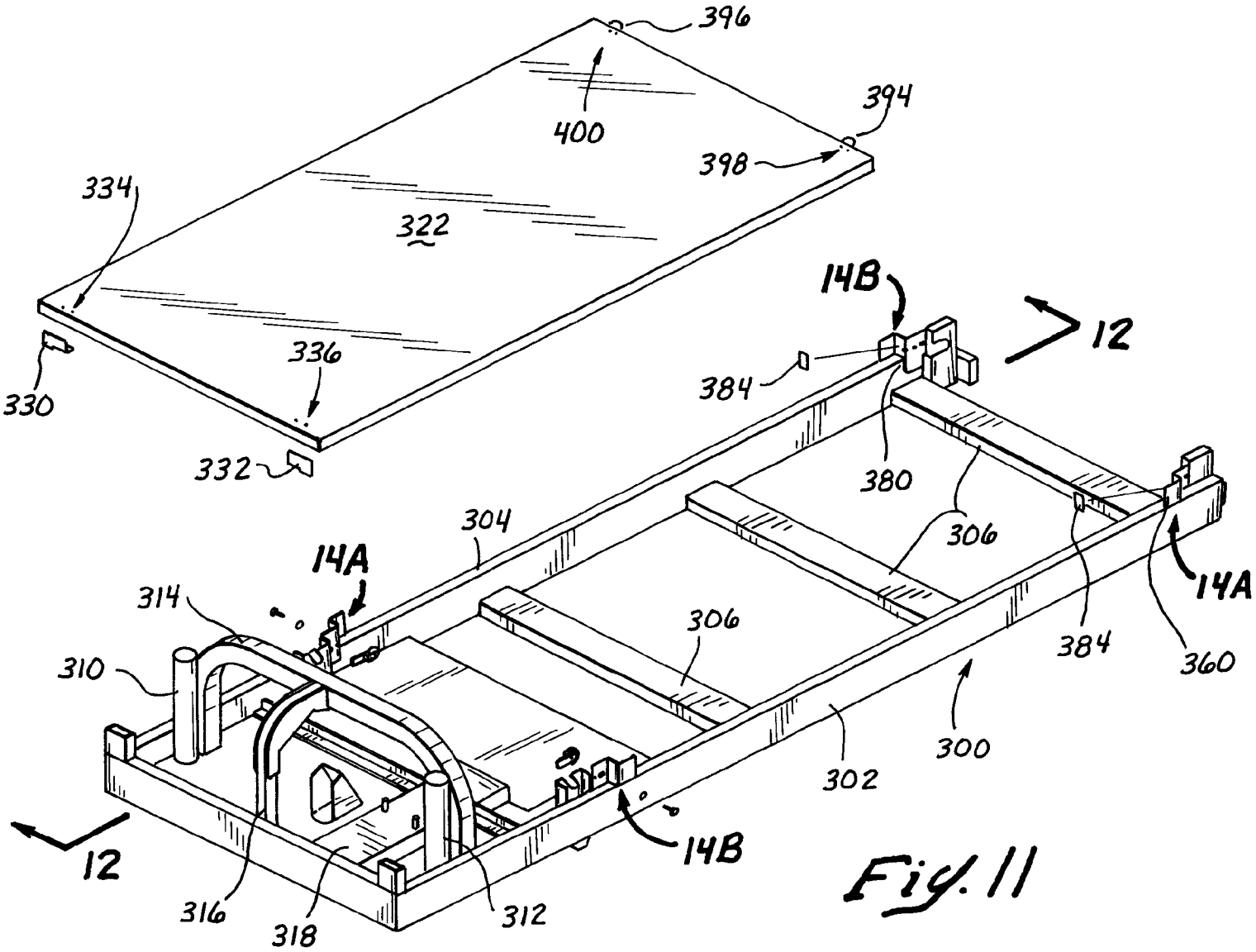
FIG. 11 is an alternative exploded perspective view of the frame and deck of this invention.

Looking more particularly at FIGS. 11 through 14, it can be seen that FIG. 11 shows a frame 300 with longitudinal rail sections 302 and 304. The longitudinal rail sections 302 and 304 are interconnected by cross members 306. Cross members 306 and longitudinal members permit the mounting of the brackets for a user into respective tubes 310 and 312 on either side. Further to this extent, a U shaped bracket for bracing and allowing upright movement in the form of bracket 314 is shown connected to a downwardly L shaped depending bracket 316. A motor mount 318 is shown having studs or pins in order to mount a motor thereon.

A deck 322 is shown having a generally rectangular shape, formed from a medium density fiber board which can be modified to be formed of other composites including plywood, honeycomb, plastic composites, as well as a metal deck. In this case, the deck 322 is provided with a phenolic laminate bonded thereto for reduced friction of the belt shown as belt 326 passing thereover and thereunder.

The front portion of the deck 322 mounts a pair of contact brackets, glides or contact plates 330 and 332 that are secured into holes 334 and 336 by fastening means such as rivets, screws, bolts, or other suitable fastening means. The contact plates 330 and 332 can have a smooth metal surface, or be provided as plastic items having smooth surfaces formed of nylon, Teflon, Delrin, or other types of materials. Also, the metal plates 330 and 332 can be formed as a laminate or have a plastic glide surface or contact member bonded thereto.

Figure 12:
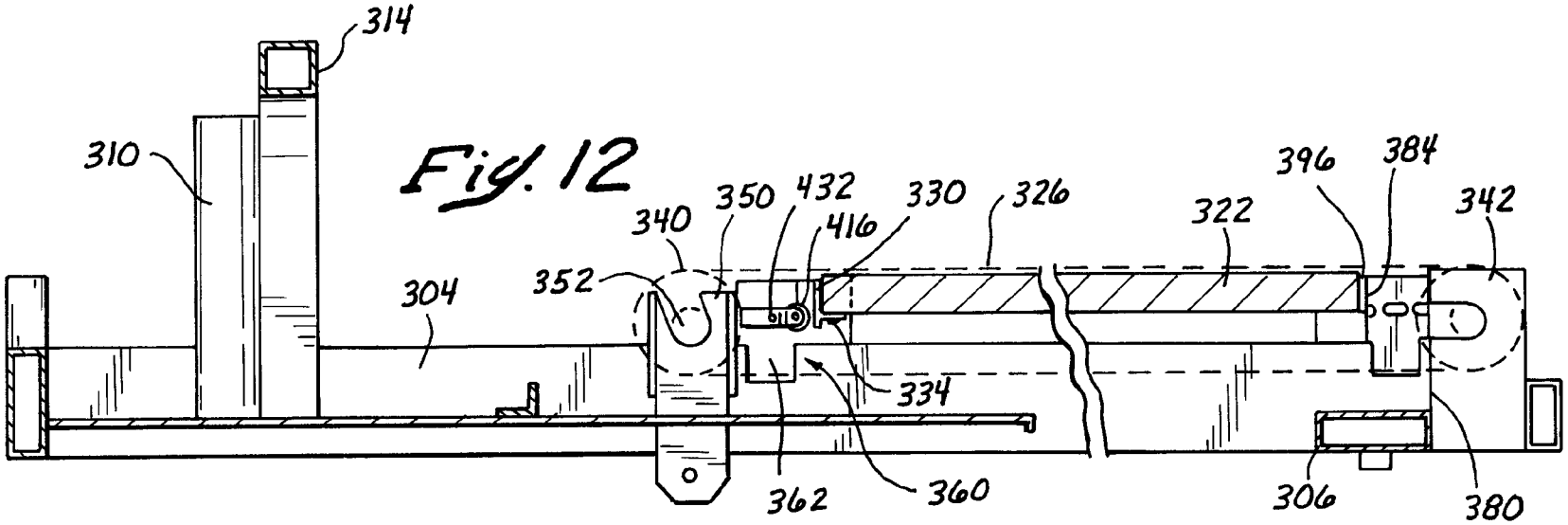
FIG. 12 is a fragmented partially sectioned view in the directions of line 12—12 of FIG. 11.

As can be seen from FIG. 12, a drive roller 340 is provided with an idler roller 342. These in turn drive the belt 326. The roller 340 can be inserted into a slot 350 on one side and a hole or opening at its axle 352 on the other side of the frame.

Figure 14B:
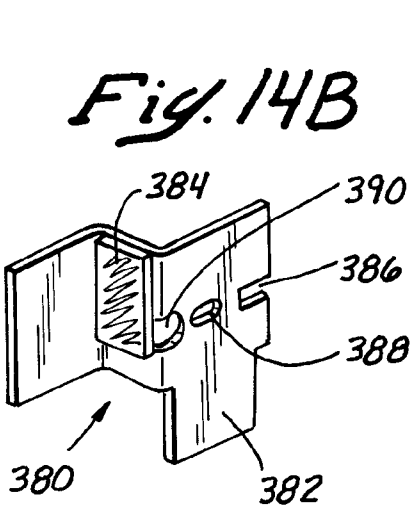
FIGS. 14A and 14B are perspective views of brackets with low friction surfaces mounted thereon as partially encircled by circles 14A and 14B of FIG. 11.
Figure 14A:
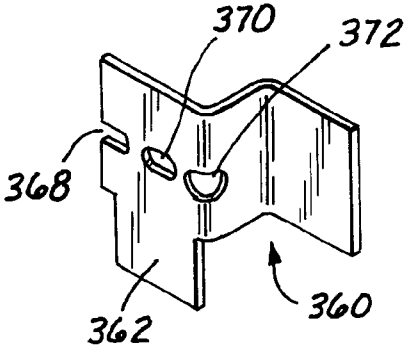

In order to secure the deck 322 at the rear of the frame 300, it can be seen wherein a rear bracket of a generally Z shaped configuration is shown. The bracket as shown in FIGS. 14A and 14B form complimentary brackets. The bracket shown in FIG. 14A namely bracket 360 is welded by a depending portion or tab 362 to the frame. The bracket 360 has the tab 362 which can be welded to the frame but can be secured in any other suitable manner such as by bolts, screws, rivets, and other threaded and unthreaded fasteners.

The bracket 360 also incorporates a slot 368 and an opening for receiving a bolt 370. A roller pin or axle head receipt opening 372 is also shown to receive the head of a pin or axle as shall be described hereinafter. This particular bracket 360 is shown having a Teflon or other glide surface or contactor formed of smooth plastic that has been attached by any suitable means. This is hidden in FIG. 14A but can be seen in FIG. 14B.

FIG. 14B shows a second complimentary bracket 380 having a depending portion or tab 382 with a Teflon pad 384 described but not shown hereinbefore. The Teflon pad 384 is connected or adhered to both brackets 360 and 380.

The bracket 380 is also of a Z shaped configuration having the Teflon pad connected to the inner or cross portion of the Z. Here again, the tab 382 can be welded to the frame or connected in any other suitable manner. The bracket 380 also incorporates a slot 386 with a bolt opening 388 and a pin receipt opening 390. When the Teflon pad or other suitable glide means is against the surface of the deck 322, it allows the deck to move upwardly and downwardly. Further to this extent, for enhanced movement, the deck can be provided with a pair of button bumpers 394 and 396 or other bumper means secured by screws or fastening means 398 and 400 as well as any other suitable relatively low friction contactor.

The brackets in FIGS. 14A and 14B have been shown mounted at the real of the frame. They are also mounted at the front of the frame in a cross complimentary manner. The bracket shown in FIG. 14A from the left rear is mounted to the right front while the bracket shown in FIG. 14B from the right rear is mounted to the left front. These two respective brackets do not include, when they are mounted on the front, the Teflon pads 384. Instead, they incorporate a roller bracket shown in FIG. 13.

Figure 13:
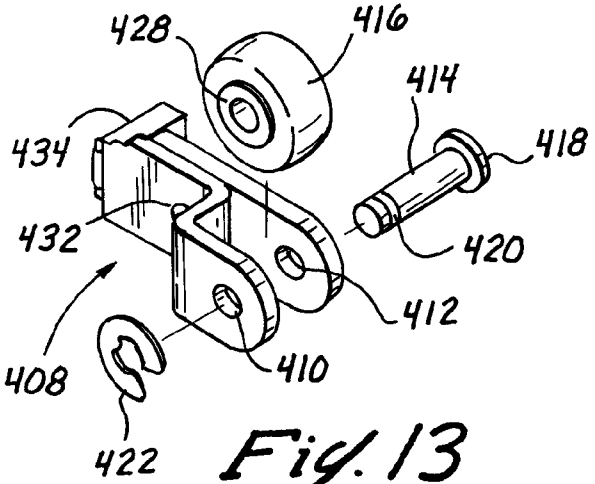
FIG. 13 is an exploded perspective view of a roller and bracket utilized with the invention as seen in FIG. 11.

The roller bracket of FIG. 13 in particular is shown as roller bracket 408 having two openings 410 and 412 with a pin or axle 414 passing therethrough. The pin 414 serves as an axle or bearing surface upon which a roller 416 is mounted. The pin 414 has an enlarged head 418 and a slot or groove 420 which receives an E clip or spring clip 422 when clipped thereover to secure the pin 414 in the holes 410 and 412. The roller 416 has a bearing 428 which can be formed as a roller bearing, ball bearing, or a plain metal bearing surface.

Bracket 408 incorporates a screw hole or bolt fastening or hole opening 432 and a tab 434. Tab 434 is slid into the slot 368 or 386 while the bolt hole opening 432 is inserted into the opening respectively 370 and 388 of brackets 360 and 380. The roller 416 should be placed in contact with the deck 322. In order to do this, the brackets 360 and 380 are welded to the frame respectively on the longitudinal members and in turn, the roller mounting bracket 408 is pressed with its roller snugly against plates or surfaces provided by contact plates 330 and 332.

In order to diminish and restrict longitudinal movement, the roller 416 is driven against the contact plate's surfaces 330 and 332. The showing of FIG. 12 shows the roller 416 before it is moved up against the surfaces of contact plates 330 and 332. Afterwhich it is secured by a bolt, screw or other means through the opening 432 to the respective holes 370 and 388 of brackets 360 and 380. The head 418 is allowed to project into the openings 372 and 390 while the tab 334 slides along opening or slots 368 and 386 for tight secured retention therein.

Other embodiments for restricting longitudinal movement can be incorporated for providing roller surfaces whether they be elongated or narrow rollers and glide surfaces, contactors, or contact members for substitution of the foregoing longitudinal retention systems. Such embodiments provide elimination or diminishing of longitudinal movement. Consequently, this invention should be read broadly in light of the following claims.

What is claimed is:

1. An exercise treadmill with a deck retention system comprising:

a frame;

a deck supported in part by a resilient member on said frame;

a continuous belt having an upper run over said deck for unidirectional longitudinal movement over said deck, and a lower run under said deck;

a drive roller connected to a motor for driving said belt;

a glide surface connected to said frame in contact with a front or rear edge of said deck; and, at least one roller connected to said frame emplaced in contact with a front or rear edge of said deck to restrict longitudinal movement of the deck between said glide surface and said roller, while at the same time permitting upward and downward movement of said deck.

2. The treadmill as claimed in claim 1 further comprising:

plural rollers in contact with the front edge of said deck.

3. The treadmill as claimed in claim 1 wherein:

said glide surface is formed from at least one rod in contact with the edge of said deck.

4. The treadmill as claimed in claim 3 wherein:

said glide surface is formed of a plastic rod bolted upright to said frame having its surface in contact with the rear edge of said deck.

5. The treadmill as claimed in claim 1 further comprising:

a plate mounted on the front edge of said deck in contact with said roller.

6. The treadmill as claimed in claim 4 further comprising:

a glide surface on the rear edge of said deck in contact with said rod.

7. The treadmill as claimed in claim 1 further comprising:

a bracket mounting said roller formed with two plates having a pin therethrough for journaling said roller for rotational movement thereon; and, a fastener for securing said bracket to said frame.

8. An exercise treadmill having a deck mounted on a frame for upward and downward movement with a belt driven for unidirectional movement on said deck with longitudinal movement restriction of said deck while at the same time permitting upward and downward movement comprising:

contact members at the front and back of said deck in contact with the edges of said deck, mounted to said frame to restrict only longitudinal movement between said contact members.

9. An exercise treadmill as claimed in claim 8 wherein:

one of said contact members comprises a roller.

10. An exercise treadmill as claimed in claim 8 wherein:

one of said contact members comprises a plastic member having a glide surface.

11. An exercise treadmill as claimed in claim 8 wherein:

one of said contact members is a roller and another contact member is a plastic member having a glide surface.

12. An exercise treadmill as claimed in claim 8 wherein:

each of said contact members at the front and back is a roller.

13. An exercise treadmill as claimed in claim 8 wherein:

each of said contact members at the front and back is a contact having a plastic glide surface.

14. An exercise treadmill as claimed in claim 9 wherein:

said roller is mounted in the uprights of a U shaped bracket having a pin forming an axle for said roller; and, said bracket is bolted to said frame to place said roller in contact with the edge of said deck.

15. An exercise treadmill comprising:

a frame;

a deck mounted on said frame on a resilient member;

a continuous belt overlying and underlying said deck;

at least one motor driven roller for driving said belt in a unidirectional manner;

at least one roller connected to said frame in a fixed relationship in rotational contact with the edge of said deck; and, a member connected to said frame having a plastic glide surface in contact with the edge of said deck to allow up and down movement of said deck between said roller and said plastic glide surface while restricting longitudinal movement when said deck is impacted.

16. The exercise treadmill as claimed in claim 15 wherein:

said roller is at the front of said deck and said plastic glide surface is at the rear of said deck.

17. The exercise treadmill as claimed in claim 16 wherein:

said roller is mounted on a U shaped bracket between the upstanding portions thereof on a pin, and said bracket is mounted to said frame with bolts.

18. The exercise treadmill as claimed in claim 17 wherein:

said deck has a plate in contacting relationship to the surface of said rollers.

19. The exercise treadmill as claimed in claim 15 wherein:

said roller is mounted in a bracket having a tab for receipt in a slot of a second bracket connected to said frame.

20. An exercise treadmill having a deck resiliently mounted for upward and downward movement on a frame with a belt which can travel longitudinally and unidirectionally over and under said deck wherein the improvement comprises:

a contact member located and facing the front edge of said deck and located and facing the rear edge of said deck mounted on said frame; and, an engaging member on said deck in facing relation to said contact members at the front and rear edges of said deck to diminish longitudinal movement of said deck while allowing upward and downward movement.

21. An exercise treadmill as claimed in claim 20 wherein:

at least one of said contact members is a roller mounted to said frame.

22. An exercise treadmill as claimed in claim 20 wherein:

at least one of said contact members is a plastic member.

23. An exercise treadmill as claimed in claim 20 further comprising:

a contact member formed as a roller on a bracket mounted to said frame; and, a second contact member which is a plastic member.

24. An exercise treadmill as claimed in claim 23 wherein:

said roller contacts said deck at the front and said plastic member at the rear of said deck.

* * * * *